United States Patent [19]

Hilgarth

[11] Patent Number: 4,959,914

[45] Date of Patent: Oct. 2, 1990

[54] SKI-BOOT

[75] Inventor: Kurt Hilgarth, Graz, Austria

[73] Assignee: Skischuhfabrik Dynafit Gesellschaft mbH, Graz, Austria

[21] Appl. No.: 265,811

[22] Filed: Nov. 1, 1988

[30] Foreign Application Priority Data

Dec. 30, 1987 [AT] Austria ..... 3452/87

[51] Int. Cl.[5] ..... A43B 5/04; A43B 3/26

[52] U.S. Cl. ..... 36/120; 36/97; 36/119

[58] Field of Search ..... 36/117–121, 36/97, 87, 105

[56] References Cited

U.S. PATENT DOCUMENTS

| | | | |
|---|---|---|---|
| 2,112,052 | 3/1938 | Smith | 36/97 |
| 2,452,502 | 10/1948 | Tarbox | 36/87 |
| 3,640,003 | 2/1972 | Anderson | 36/119 |
| 4,083,128 | 4/1978 | Rossman | 36/97 |
| 4,126,323 | 11/1978 | Scherz | 36/97 X |
| 4,160,332 | 7/1979 | Salomon | 36/119 |
| 4,308,674 | 1/1982 | Tessaro | 36/118 |
| 4,757,621 | 7/1988 | Iwama | 36/119 |

FOREIGN PATENT DOCUMENTS

| | | | |
|---|---|---|---|
| 2446066 | 4/1976 | Fed. Rep. of Germany | 36/120 |
| 3044052 | 6/1982 | Fed. Rep. of Germany | 36/120 |

*Primary Examiner*—James Kee Chi

*Attorney, Agent, or Firm*—Fleit, Jacobson, Cohn, Price, Holman & Stern

[57] ABSTRACT

A ski boot comprises a shell and shaft designed for stepping in from the rear and composed of a collar and a lid. The collar and the front portion of the shell form a first integral part, whereas the rear, heel portion of the shell together with the lid form a second integral part. The two integral parts are pivotal about an axis in the sole region, transverse to the travelling direction and are mutually fixable in the position of use.

12 Claims, 2 Drawing Sheets

SKI-BOOT

BACKGROUND OF THE INVENTION

The invention relates to a ski-boot comprising a toe shell and a heel shell, the latter being hinged to the toe shell in the bottom region about a hinge line transverse to the direction of travel, the two shells when swung apart permitting stepping into the boot and being adapted to be fixed in the position where the two shells are swung towards each other for skiing.

In conventional ski-boots of this type, the shaft is pivotally mounted about an axis transverse to the direction of travel, the lid as well being tiltable towards the rear about the same axis or an axis parallel thereto. In such boot the components for each boots size must be manufactured to an appropriate shape, whereby the manufacture is rendered expensive and the assembly is cumbersome.

GENERAL DESCRIPTION OF THE INVENTION

It is an object of the present invention to provide a boot which is manufactured simply and different sizes of which can be assembled at least in part from the same components.

This object is attained in a ski-boot of the type recited in the introduction, in that according to the invention at least one of the two shells, preferably the toe shell comprises in the bottom region an extension which projects into the other shell and which after the boot has been stepped into, is trodden down to enter into a locking position, whereby the two shells are fixed in relation to one another.

Quite apart from the simplicity of production of these two parts, both parts being suitable for manufacture by pressing, it is also possible in the production of such boots to combine rear or heel portions of different lengths with identical front portions or vice versa in order to attain different shoe sizes. Bearing in mind that the increments between the individual whole shoe sizes amount to approximately 8 mm and to about 2 mm between individual boot width, the expedients according to the invention provide a substantial simplification of the ski-boot manufacture. This may be further improved according to a further feature of the invention, in that at least one of the two shells comprises a plurality of linkage members arranged in succession, selectable at will for being connected to the linkage member or linkage members of the other shell.

BRIEF DESCRIPTION OF THE DRAWINGS

Further details of the invention will be explained in more detail with reference to the drawings, in which a working example of the ski-boot according to the invention is illustrated. There is shown in.

DESCRIPTION OF A PREFERRED EMBODIMENT

Figure 1:
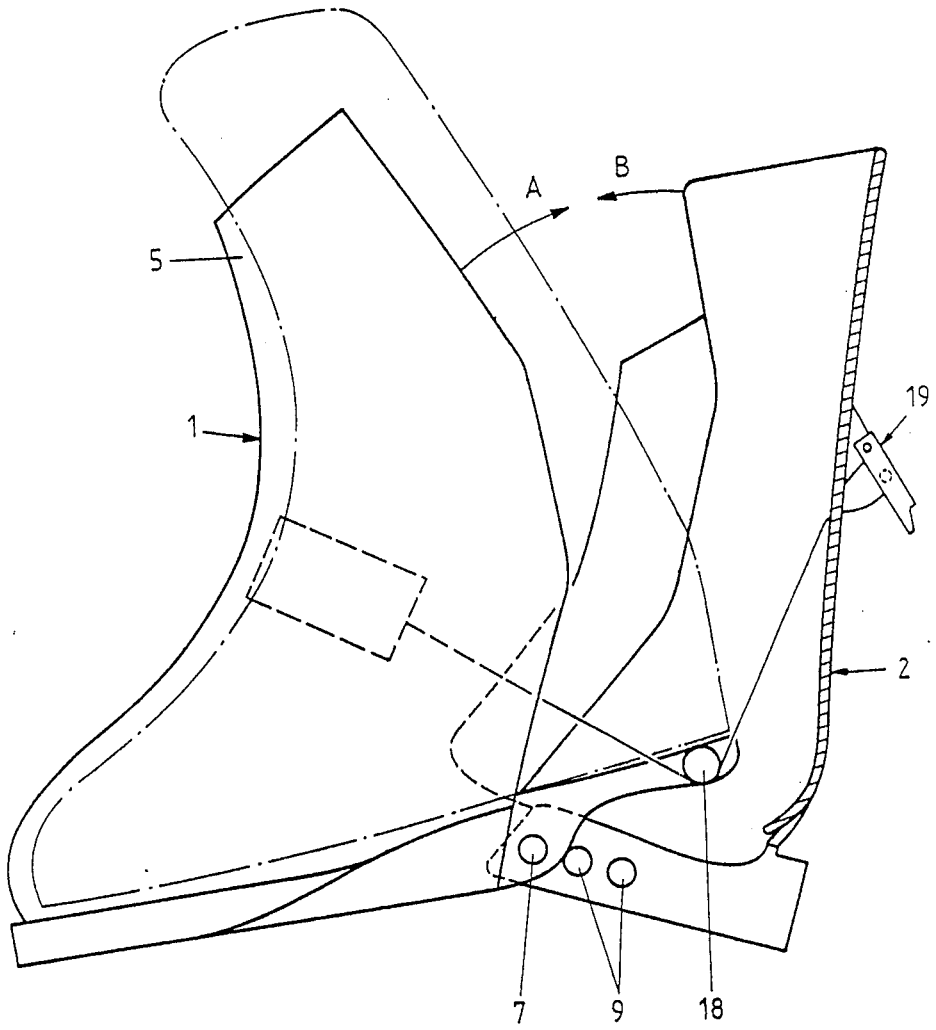
FIG. 1, a side elevation of the ski-boot in the opened condition.
Figure 2:
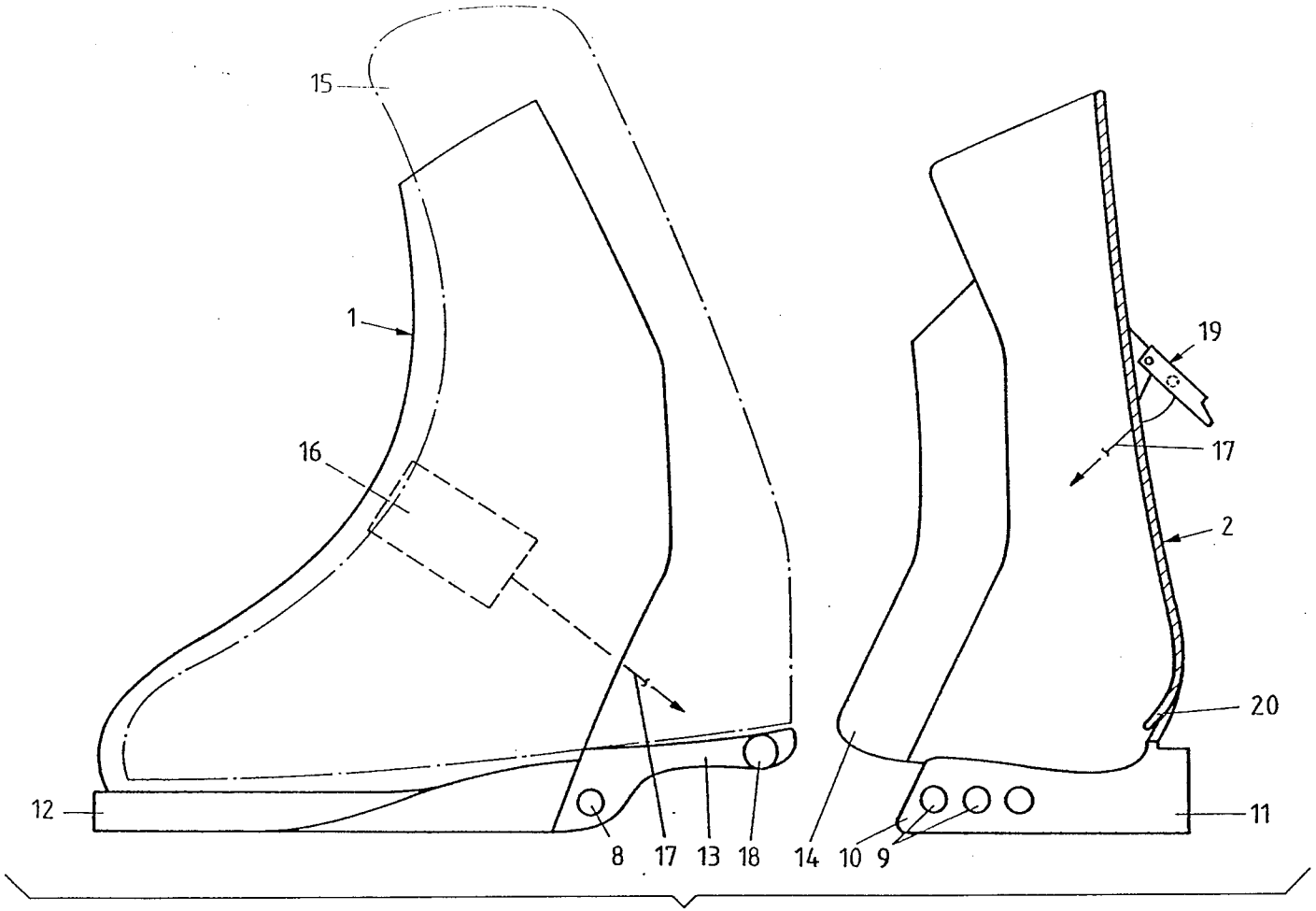
FIG. 2, the two ski-boot portions separate from one another in side elevation.

The ski-boot according to the invention comprises two parts, namely a toe shell 1 and a heel shell 2. The two shells 1, 2 are interconnected by a hinge means 7 in the sole region at their mutually facing ends, for which purpose a bore 8 passes right through the sole 12 of the toe shell 1, in alignment with one of the three bores 9 of an extension 10 of the sole 11 of the heel shell 2 when in the assembled condition, such that a pin can be passed therethrough to complete the hinge 7. The provision of a plurality of bores 9 serves the purpose to permit the boot being made longer or shorter by adjustment from one bore to the next.

The sole portion 12 of the toe shell 1 is provided on the heel side with an extension 13 which in the position of use of the ski-boot rests on the inside of the sole portion 11 of the heel shell 2. In this context the extension 13 is provided at its underside with profiles, e.g. longitudinal ribs, which interengage with matching profiles, e.g. grooves, on the inside of the sole portion 11 of the heel shell 2.

In the position of use, the two parts 1 and 2 overlap, for which purpose the heel shell 2 along its edges is provided with flaps 14 which bear from within against the edges of the toe shell 1 along the arch side.

A lining sock 15 inserted into the toe shell 1 is open on the heel side and there is closed by a cushion means fitted to the inside of the heel shell 2. Between the inside of the toe shell 1, in the region of the instep, a pressure distribution plate 16 is provided, connected on both sides of the foot to a cable means 17 which by way of a deflecting pulley 18 or the like passes to the inside of the heel shell 2 and to a fixing region, not illustrated, on the rear of the latter.

The ski-boot in accordance with the invention is used as follows:

For stepping into the ski-boot the latter is folded open into the position illustrated in FIG. 1. The skier can now step into the boot comfortably, since the ski-boot is more widely open than conventional ski-boots. After having stepped in, the skier presses his foot against the sole, whereby the two parts 1, 2 are snapped together in the direction of the arrows (A, B) about the hinge 7, the free end of the extension 13 snapping into a snaplock 20 of the heel shell 2, to keep the ski-boot closed.

If the above described pressure distribution plate 16 and the cable means 17 are provided, the latter also contributes to securing the ski-boot in the closed position due to the deflector pulley 18 being moved downwardly when the parts 1 and 2 are snapped together, causing tensioning of the cable means.

For stepping out of the ski-boot, the snaplock 20 is disengaged from the end of the extension 13, e.g. by being pressed inwardly, thereby to release the extension 13 whereupon the ski-boot can be returned to the position illustrated in FIG. 1 in which the skier can step out easily.

It stands to reason that various constructional modifications can be made within the scope of the invention. For example, it is possible to provide a plurality of successive bores 9 in the toe shell 1 instead of the heel shell 2, which can be selected to be brought into alignment with a matching bore of the heel shell 2, as a result of which, using the same components 1, 2, different shoe sizes can be produced, three shoe sizes in the present case in which three bores are illustrated.

Grooves, flexing regions or the like may be provided in the wall of the shaft in order to render the ski-boots resilient in the ankle region.

Moreover, it is possible to design the hinge 7 differently from the illustration. It is also possible to provide additional closure means for securing the ski-boots in the position of use.

The claims which follow are to be considered an integral part of the present disclosure. Reference numbers (directed to the drawings) shown in the claims serve to facilitate the correlation of integers of the claims with illustrated features of the preferred embodiment(s), but are not intended to restrict in any way the language of the claims to what is shown in the drawings, unless the contrary is clearly apparent from the context.

What we claim is:

1. A ski-boot comprising:

a toe shell having an inside, an outside, an arch region and a sole region, a heel shell, said toe shell having a sole portion and an extension projecting into said heel shell, a lining sock inserted into said toe shell, said sock being open on a heel side, a cushion means provided on the inside of said heel shell for closing said lining sock, a hinged connection hinging the heel shell to said toe shell in a partition region of the shells at a back part of the sole region thereof in the partition region of the shells, about a hinge line transverse to the longitudinal direction of the boat, so that both of said shells can swing in a downward direction with respect to said hinge line, the two shells, when swung apart, permitting stepping into the boot and being fixed together in the position where the shells are swung towards each other, at least one of said shells comprising a plurality of bores arranged, in succession, at several positions in a longitudinal direction of said ski-boot to enable formation of said hinged connection at one of a plurality of predetermined longitudinal positions so that said shells are mutually adjustable in said longitudinal direction, a releasable snaplock member provided on said heel shell, into which said extension of said toe shell snaps when the ski-boot is stepped into, the two shells overlapping, and flaps provided in edge regions of said heel shell which bear against the inside of the toe shell in the arch region.

2. A ski-boot according to claim 1, wherein the extension of the toe shell rests on an inside of the sole portion of the heel shell during use of the ski-boot.

3. A ski-boot according to claim 1, wherein the extension is provided at its underside with profiles which interengage with matching profiles on an inside of the sole portion of the heel shell.

4. A ski-boot according to claim 2, wherein the extension is provided at its underside with profiles which interengage with matching profiles on an inside of the sole portion of the heel shell.

5. A ski-boot according to claim 3, wherein said profiles are longitudinal ribs and said matching profiles are grooves.

6. A ski-boot according to claim 4, wherein said profiles are longitudinal ribs and said matching profiles are grooves.

7. A ski-boot comprising:

a toe shell having an instep region, an arch region and a sole region, a heel shell having an inside, a fixing region at the rear thereof and a sole portion, said toe shell having an extension projecting into said heel shell, a lining sock inserted into said toe shell, said lining sock being open on a heel side, a cushion means provided on the inside of said heel shell for closing said lining sock, a pressure distributing plate provided in the instep region between the lining sock and the toe shell, a cable means connected to said pressure distributing plate on both sides of a foot, a deflecting pulley provided at a back end of said extension and passing said cable means along the inside of the heel shell to the fixing region at the rear thereof, a hinged connection hinging said heel shell to said toe shell at a back part of the sole region at a partition region of the shells, about a hinge line transverse to a longitudinal direction of the ski-boot, so that both of said shells can swing in a downward direction with respect to said hinge line, the two shells, when swung apart, permitting stepping into the boot and being fixed together in the position where the two shells are swung towards each other, at least one of said shells comprising a plurality of bores arranged, in succession, at several positions in the longitudinal direction of said ski-boot to enable formation of said hinged connection at one of a plurality of predetermined longitudinal positions so that said shells are mutually adjustable in said longitudinal direction, a releasable snaplock member provided on said heel shell, into which said extension of said toe shell snaps when the ski-boot is stepped into, the two shells overlapping, and flaps provided in edge regions of said heel shell which bear against the inside of the toe shell in the arch region.

8. A ski-boot according to claim 7, wherein the extension of the toe shell rests on the inside of the sole portion of the heel shell during use of the ski-boot.

9. A ski-boot according to claim 7, wherein the extension is provided at its underside with profiles which interengage with matching profiles on an inside of the sole portion of the heel shell.

10. A ski-boot according to claim 8, wherein the extension is provided at its underside with profiles which interengage with matching profiles on an inside of the sole portion of the heel shell.

11. A ski-boot according to claim 9, wherein said profiles are longitudinal ribs and said matching profiles are grooves.

12. A ski-boot according to claim 10, wherein said profiles are longitudinal ribs and said matching profiles are grooves.

* * * * *